US007014080B2

(12) United States Patent
Cheng

(10) Patent No.: US 7,014,080 B2
(45) Date of Patent: Mar. 21, 2006

(54) RIBBON ASSEMBLY FOR FORMING A DECORATIVE BOW

(76) Inventor: Kui Eng Cheng, Flat B, 8/F., Block B, Cornwall Court, 54 King's Road, North Point, Hong Kong (HK)

( * ) Notice: Subject to any disclaimer, the term of this patent is extended or adjusted under 35 U.S.C. 154(b) by 286 days.

(21) Appl. No.: 10/701,948

(22) Filed: Nov. 5, 2003

(65) Prior Publication Data

US 2005/0072817 A1 Apr. 7, 2005

(30) Foreign Application Priority Data

Oct. 5, 2003 (CN) ..... 200320116834

(51) Int. Cl.
*D04B 7/10* (2006.01)

(52) U.S. Cl. ..... 223/46; 428/5

(58) Field of Classification Search ..... 223/44, 223/46; 428/4, 5

See application file for complete search history.

(56) References Cited

U.S. PATENT DOCUMENTS 2,849,821 A * 9/1958 Doig ..... 223/46
3,010,236 A * 11/1961 Doig ..... 223/46
4,329,382 A * 5/1982 Truskolaski et al. ..... 428/4
4,515,837 A * 5/1985 Cheng ..... 223/46
5,114,761 A * 5/1992 Doherty ..... 223/46
5,387,446 A * 2/1995 Weder ..... 223/46
5,411,774 A * 5/1995 Weder ..... 223/46
5,567,486 A * 10/1996 Weder ..... 223/46
5,605,728 A * 2/1997 Weder ..... 223/46
5,645,902 A * 7/1997 Cheng ..... 223/46
5,679,415 A * 10/1997 Weder ..... 223/46
5,679,416 A * 10/1997 Cheng ..... 223/46
5,693,381 A * 12/1997 Cheng ..... 428/5

* cited by examiner

*Primary Examiner*—Danny Worrell
(74) *Attorney, Agent, or Firm*—Kirschstein, et al.

(57) ABSTRACT

A bow-forming ribbon assembly has a decorative flexible ribbon member and a drawstring connected loosely to the ribbon at points along its length by relatively stiff retainer members. Each retainer member extends generally transversely across the ribbon member, and each is inclined with respect to the transverse direction at an angle. Each retainer member is inclined at an angle different from that of an adjacent retainer member. Decorative arms having adornments are mounted adjacent at least some of the retainer members. On forming the ribbon into a bow by pulling the drawstring relative to the ribbon member, the inclined retainer members tend to skew the adjacent loops or segments of the bow relative to one another, as well as the decorative arms so that the loops and the arms are distributed at various angles around the axis of the bow, thereby providing a bow of great visual interest.

10 Claims, 2 Drawing Sheets

RIBBON ASSEMBLY FOR FORMING A DECORATIVE BOW

BACKGROUND OF THE INVENTION

1. Field of the Invention

The present invention relates to a ribbon assembly for forming a decorative bow, to be applied to wrapped gifts, for example.

2. Description of the Related Art

It is known to provide a ribbon with a drawstring connected loosely to the ribbon at points along its length and secured to the ribbon at one end so that a user of the ribbon assembly can draw the ribbon into a number of arcuate loops by pulling on the drawstring. One advantage of this known assembly is that the ribbon assembly can be packed flat, thus greatly facilitating and reducing the costs of storage and transport of the ribbon assemblies as compared with preformed bows which are relatively bulky and need to be packed in crush-proof containers.

Prior ribbon assemblies, however, suffer from the disadvantage that, upon pulling the drawstring, the ribbon tends to fold itself into loops which are all aligned in one vertical plane, thus forming a fan shape. This is inconvenient to the user who normally requires the bow to be arranged in a more decorative rosette or pom-pon form, and necessitates the user having to pull on the individual loops to rotate them laterally and rearrange them so that the loops are spaced angularly around a central vertical axis of the bow. Apart from being time-consuming, this manipulation increases the risk of the bow becoming torn, damaged or soiled.

It is also known from U.S. Pat. No. 4,515,837 to provide a bow-forming ribbon assembly comprising at least one decorative flexible ribbon member, and a series of relatively stiff retainer members which may be in plate form, or may be wire, spaced apart at intervals along the length of the ribbon member. Each retainer member is restrained against movement relative to the ribbon member and defines an aperture extending generally transversely across the ribbon member at an angle with respect to the transverse direction. Each retainer member extends at an angle different from that of the adjacent preceding retainer member. At least one drawstring member runs freely through the apertures defined by the successive retainer members.

With this known patented assembly, as the bow is being formed by pulling on the drawstring, each relatively stiff retainer member tends to seat itself on the bow loop that is being formed immediately adjacent thereto in an angularly skewed orientation relative to the latter, and tends to skew each loop of the bow relative to the loop beneath, so that the loops of the bow are arranged in angularly spaced rosette or pom-pon like form. Desirably, each retainer member is inclined at an angle opposite to that of the preceding member.

As advantageous as the known patented assembly is in forming a rosette bow without undue manipulation of the bow loops, it is desirable, especially from an aesthetic viewpoint, to make the rosette bow of more visual interest and fuller in appearance. The loops tend to flatten over time and give the bow a plain appearance.

SUMMARY OF THE INVENTION

3. Objects of the Invention

One object of this invention is to provide a rosette bow with a fuller, more aesthetically appealing appearance.

Another object of this invention is to provide a bow with a starburst-like arrangement of decorative elements radiating outwardly from a center of the bow.

FEATURES OF THE INVENTION

In keeping with these objects and others which will become apparent hereinafter, one feature of this invention resides, briefly stated, in a bow-forming ribbon assembly comprising at least one flexible ribbon member, and preferably a pair of juxtaposed ribbon members, and a plurality of relatively stiff retainer members mounted on, and spaced apart lengthwise along, the ribbon members. Each retainer member is restrained against movement relative to the ribbon members and defines an aperture extending generally transversely across the ribbon members at an angle with respect to the transverse direction. Each retainer member extends at an angle different from that of an adjacent retainer member. At least one drawstring member, and preferably a pair of drawstring members, is secured to one end of the ribbon member or ribbon members and runs freely through the apertures formed by the successive retainer members.

In accordance with this invention, a plurality of decorative arms is mounted at at least some of the retainer members. Upon forming the bow by pulling the drawstring members relative to the ribbon members, the retainer members are gathered together, and segments of the ribbon members between successive retainer members are folded to form bow loops which are angularly spaced apart from one another due to the different angled orientations of the retainer members. The decorative arms, likewise, are angularly spaced apart and provide the bow with a starburst-like arrangement with the decorative arms radiating outwardly in different directions from a center of the bow.

Each decorative arm has a decoration at its outer free end region. The decoration may be a star, a heart, or virtually any adornment. The decoration may even be, or include, any text, for example, the words "Happy Birthday". The decorative arms for any one bow can include the same adornment, or different adornments, for even greater visual appeal.

Each decorative arm has a mounting portion at its inner free end. The mounting portion preferably has a neck inserted into the aperture of a respective retainer member. It is also possible to make the retainer member and the decorative arm of a common, one-piece construction.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 3:
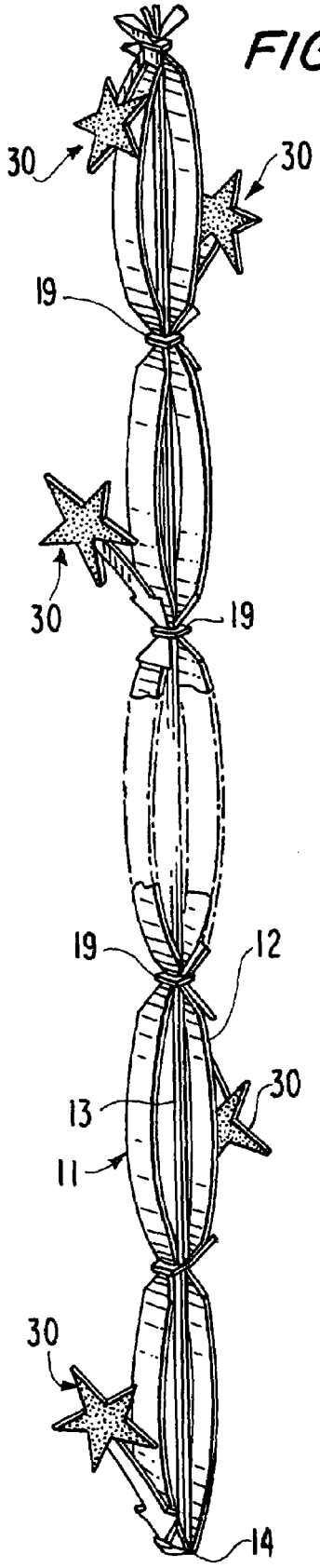
FIG. 3 is a perspective view of the ribbon assembly of FIG. 1 during initial formation of a bow.

Referring to the drawings, FIG. 3 shows two elongated ribbon members 11 and 12 disposed in face-to-face relationship. The members 11 and 12 are formed by taking a length of conventional decorative ribbon material, e.g., a conventional synthetic plastic having a satin-like fibrous texture, and folding it at its middle portion 14. A drawstring 13, which may be formed of a narrower width of the same material as the members 11 and 12, is connected to the members 11 and 12, and passes between the two members 11 and 12. In the example illustrated, the drawstring 13 is a double length of material which is tied in a knot at its middle around the middle portion 14 of the folded-over ribbon members 11 and 12. Although in the example illustrated, the ribbon is formed from two ribbon members 11 and 12 and a double length of the drawstring material 13 is provided, as will be appreciated, the ribbon may instead comprise only a single length of the ribbon material 11, and only a single drawstring 13 may be provided, attached to the single ribbon member 11 at one end.

Figure 1:
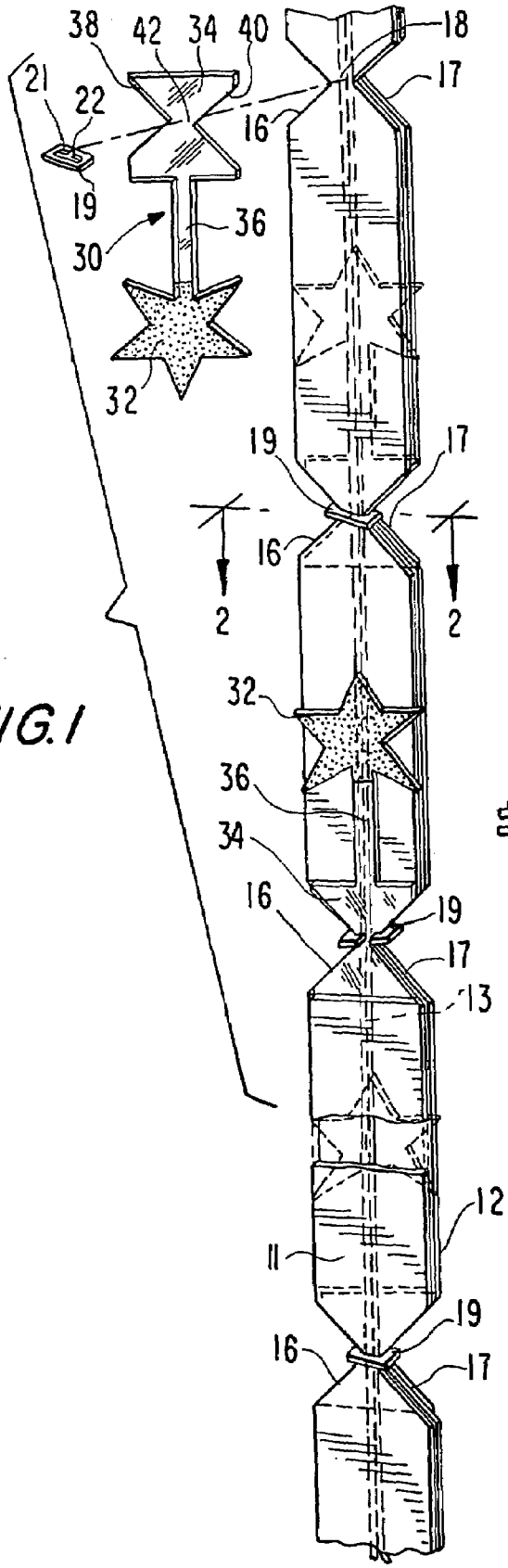
FIG. 1 is a broken-away exploded view of a bow-forming ribbon assembly in accordance with the invention.

As best seen in FIG. 1, each ribbon member 11 and 12 is formed into a series of segments, preferably of approximately uniform length, by V-shaped indentations 16 and 17 cut on opposite sides of the ribbon members. The indentations 16 and 17 are offset longitudinally from one another on opposite edges of the ribbon members 11 and 12 so that a narrow neck portion 18 is formed between each indentation which has its narrowest portion inclining at a small angle, e.g., about 30° to 40°, with respect to the transverse width of the ribbon members 11 and 12. The successive pairs of indentations 16 and 17 are formed so that each neck portion 18 inclines at an angle different from that of the preceding neck portion. In the preferred form, as shown in FIG. 1, the angle of inclination of each neck portion 18 is equal, but each inclines in a direction opposite to that of the preceding neck portion 18.

A retainer member 19 is applied around each neck portion 18. Each retainer member comprises a small piece of a sheet material which is relatively stiff compared to the ribbon members 11 and 12. The retainer member may, for example, comprise apiece of thin and stiff plastic material e.g., a cellulose plastic material. The retainer member 19 is provided with a central aperture 21 of a width to receive the narrow neck portions 18 of the ribbon members 11 and 12 and the drawstring members 13, the latter being received sufficiently loosely so that they can be pulled relatively freely between the neck portions 18. The retainer member 19 is formed with a slot or cut 22 extending inwardly from one edge to the aperture 21. The retainer member 19 is mounted by flexing it slightly to open the cut portion 22, so that the neck portions 18 and the drawstring members 13 can be introduced into the aperture 21.

Figure 2:
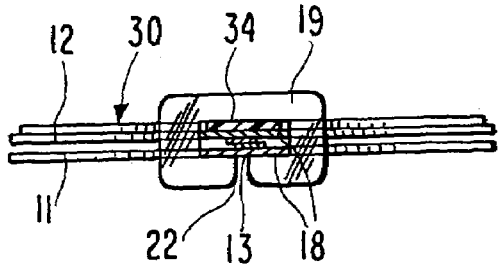
FIG. 2 is a cross-sectional view on an enlarged scale taken on the line 2—2 in FIG. 1.

As seen in FIG. 2, the neck portions 18 are received snugly in the aperture 21, so that the retainer member 19 is retained against movement longitudinally relative to the ribbon members 11 and 12, and adopts and maintains the orientation of the narrow neck portion 18. Each retainer member 19 is thus inclined at the same angle as the narrow neck portion 18, and is in the form of a small plate presenting planar front and rear faces extending generally perpendicularly of the plane of the ribbon members 11 and 12, these faces being inclined with respect to the transverse width of the ribbon members 11 and 12 and, in the example shown, each retainer member 19 being inclined in a direction opposite from that of the preceding retainer member 19.

As will be appreciated, in order to locate the retainer members 19 relative to the ribbon members 11 and 12, and to orient them at the desired angles, it is not necessary to provide indentations 16 and 17 of the V-shape illustrated. For example, a simple cut may be formed inwardly from each edge of the ribbon member, the cuts being offset to provide a narrow land or intervening portion around which the retainer member 19 may be clipped.

As best seen in FIG. 1, at least one decorative arm 30 is mounted at a retainer member 19. Arm 30 has an adornment 32 at an outer end region thereof, a mounting portion 34 at an inner end region thereof, and an extension 36 between the end regions thereof. Adornment 32 is illustrated as a star for convenience, but could be any shape or decoration. Adornment 32 could be, or include, any alphanumeric characters. Mounting portion 34 has indentations 38, 40 matching indentations 16 and 17, and a neck 42 matching the neck portion 18. Hence, the arm 30 can be mounted and held within the aperture 21 of the retainer member 19, as shown in FIG. 2.

A single decorative arm can be mounted at each retainer member, or at selected retainer members. More than one decorative arm can be mounted at each retainer member. The adornments 32 can be the same for a particular bow, or different adornments can be employed for the same bow.

Each decorative arm is constituted of a thin, stiff plastic material, e.g., a cellulosic plastic material, identical to that of the retainer members. The decorative arm and the retainer member can be of one-piece, die-cut construction. Preferably, the adornment 32 is die-cut from a colored material which contrasts with a transparent material for the extension 36 and mounting portion 34, the colored adornment 32 then being adhered to the extension 36.

In use, the ribbon in the flat form illustrated in FIG. 1 is converted into a decorative pom-pon or rosette-like bow by grasping the free ends of the drawstrings 13 in one hand, and retaining a portion of the drawstrings 13 adjacent the retainer member 19 which is adjacent the free ends 13 lightly between the forefinger and thumb of the other hand. The drawstrings 13 are then pulled outwardly, with the finger and thumb engaging the underside of the retainer member 19, so that the segments of the ribbon members 11 and 12 between the indentations 16 and 17 are gathered up into loops 24.

Figure 4:
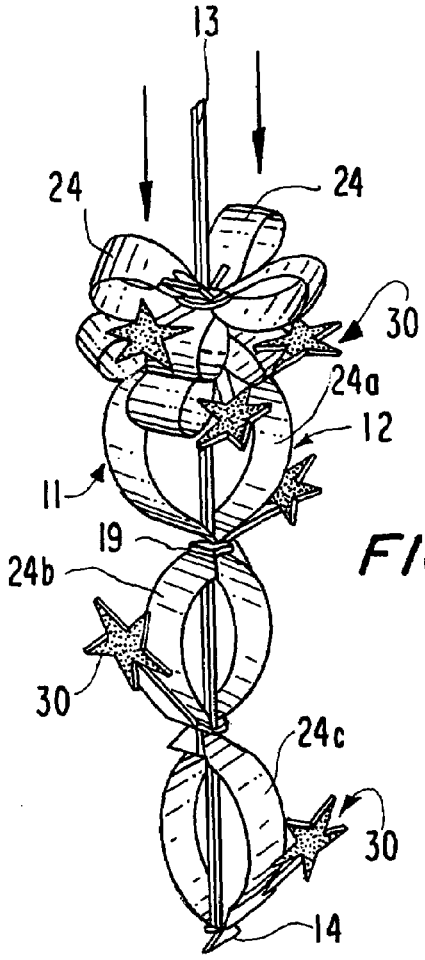
FIG. 4 is a view analogous to FIG. 3, but at a later stage of bow formation.
Figure 5:
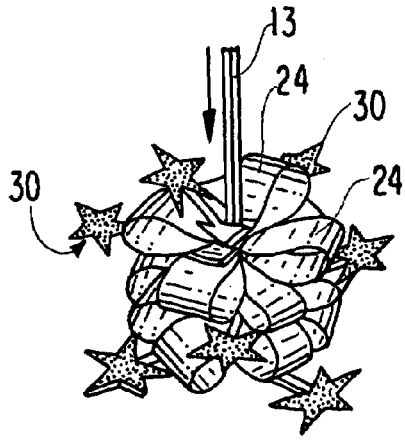
FIG. 5 is a perspective view of the completed bow with a starburst-like pattern of decorative arms.

Because of the different angled orientations of the retainer members 19, these tend to seat themselves on the bow loops, for example, the bow loops 24*a*, 24*b*, and 24*c* in FIG. 4, at angularly skewed orientations. Thus, the successive loops 24*a*, 24*b*, and 24*c* tend to be skewed angularly relative to one another at differing angles around the axis of the drawstrings 13 so that, instead of the loops 24 tending to superimpose themselves one on the other, the successive loops become arranged at differing angles spaced around the axis of the drawstrings 13 so that a bow is formed as shown in FIG. 5 with the loops 24 arranged at varying angles around the axis of the drawstrings 13, to provide a desired attractive rosette or pom-pon like form. Likewise, the decorative arms 30 follow the skewed orientations of the retainer members, and are arranged in a starburst-like pattern at varying angles around the axis of the drawstrings 13. It will be appreciated that FIG. 5 shows the completed bow with starburst-like pattern in an inverted position relative to its normal position of use.

Once the bow is formed, the drawstrings 13 may be knotted adjacent the retainer member 19 exposed on the underside of the completed bow, and the free ends of the drawstrings 13 may be cut off. Alternatively, the drawstrings may be used for tying a parcel, and may thus secure the completed bow in position around a parcel or the like to be decorated by the bow.

The bow-forming ribbon may be provided to the users with an adhesive-backed card having an aperture through which the free ends of the drawstrings 13 are threaded. The adhesive-coated surface may normally be covered by a release paper which is removed after forming the bow in order to assist in securing the completed bow to a parcel or the like.

As will be appreciated, the bow-forming ribbon assembly as illustrated may be packed flat for storage and transport. The ribbon members may, for example, be folded about the narrow or neck portions 18, with the segments of the ribbon being folded one on another, to provide a compact, folded structure. The decorative arms 30 are laid flat against the ribbon segments and are preferably shorter in length than the ribbon segment against which it is laid.

It will be understood that each of the elements described above, or two or more together, also may find a useful application in other types of constructions differing from the types described above.

While the invention has been illustrated and described as a ribbon assembly for forming a decorative bow, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A bow-forming ribbon assembly, comprising:

a) at least one decorative, flexible, ribbon member extending along a longitudinal direction;

b) a plurality of relatively stiff, retainer members spaced apart along the longitudinal direction, each retainer member having an aperture in which the ribbon member is received;

c) means for disposing the retainer members on the ribbon member at different angles of inclination relative to the longitudinal direction;

d) a drawstring member secured to one end of the ribbon member and running freely through each aperture of the retainer members; and f) at least one decorative arm having a mounting portion received in the aperture of at least one of the retainer members, and an adornment at an outer free end region of the arm.

2. The assembly of claim 1, wherein the ribbon member is folded at said one end to form a pair of juxtaposed ribbon portions.

3. The assembly of claim 1, wherein each retainer member is a planar plate.

4. The assembly of claim 1, wherein the disposing means includes a pair of indentations for each retainer member, the indentations of each pair being cuts in opposite edges of the ribbon member, the cuts being offset longitudinally from one another to bound an inclined neck portion received in the aperture of each retainer member.

5. The assembly of claim 1, wherein said at least one decorative arm has a pair of notches offset longitudinally in the mounting portion to bound an inclined neck received in the aperture of said at least one retainer member.

6. The assembly of claim 1, and additional decorative arms having additional mounting portions received in the aperture of others of the retainer members, each additional arm having an additional adornment at respective outer free end regions thereof.

7. The assembly of claim 1, and a longitudinal extension extending between the mounting portion and the adornment of said at least one arm.

8. The assembly of claim 1, wherein said at least one decorative arm is constituted of a planar sheet.

9. The assembly of claim 1, wherein said at least one decorative arm has a length shorter than a longitudinal distance between two adjacent retainer members.

10. The assembly of claim 1, wherein the adornment has a color which contrasts with a color of the mounting portion.

* * * * *